US011573008B2

(12) United States Patent
Spano et al.

(10) Patent No.: US 11,573,008 B2
(45) Date of Patent: Feb. 7, 2023

(54) METHOD FOR DETECTING ANOMALIES ASSOCIATED WITH A GAS APPLIANCE

(71) Applicant: ELECTROLUX APPLIANCES AKTIEBOLAG, Stockholm (SE)

(72) Inventors: Fabio Spano, Forlì (IT); Fabio Rasi, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 163 days.

(21) Appl. No.: 17/044,569

(22) PCT Filed: Apr. 2, 2019

(86) PCT No.: PCT/EP2019/058286

§ 371 (c)(1),
(2) Date: Oct. 1, 2020

(87) PCT Pub. No.: WO2019/201592

PCT Pub. Date: Oct. 24, 2019

(65) Prior Publication Data

US 2021/0199291 A1 Jul. 1, 2021

(30) Foreign Application Priority Data

Apr. 20, 2018 (EP) ..... 18168396

(51) Int. Cl.
*F23N 5/10* (2006.01)
*F23N 5/24* (2006.01)
(Continued)

(52) U.S. Cl.
CPC ..... *F23N 5/242* (2013.01); *F23N 5/102* (2013.01); *F24C 3/128* (2013.01);
(Continued)

(58) Field of Classification Search
CPC ..... F23N 5/123; F23N 2231/18; F23N 5/203
(Continued)

(56) References Cited

U.S. PATENT DOCUMENTS 6,000,931 A * 12/1999 Tanabe ..... G01M 3/2807 431/89
6,164,958 A * 12/2000 Huang ..... F23N 5/242 431/77

(Continued)

FOREIGN PATENT DOCUMENTS

WO 2008044107 4/2008
WO 2017013558 1/2017

OTHER PUBLICATIONS

International Search Report and Written Opinion for PCT/EP2019/058286 dated Jun. 14, 2019, 9 pages.

*Primary Examiner* — Avinash A Savani
(74) *Attorney, Agent, or Firm* — Peame & Gordon LLP

(57) ABSTRACT

The invention refers to a method for detecting anomalies associated with a gas appliance (1), the gas appliance (1) comprising at least a gas inlet (2), at least one gas burner (3) and gas distribution means (4) coupling the gas inlet (2) with said at least one gas burner (3), the method comprising the steps of: —gathering information regarding the gas flow or the operational state based on detection means (5.1, 5.2) (S20); —evaluating said gathered information in order to detect gas flow anomalies or operational anomalies, thereby obtaining evaluation information (S21); —providing alert information from a communication interface of the gas appliance (1) to a user device (6) depending on said evaluation information (S22).

18 Claims, 3 Drawing Sheets

(51) Int. Cl.
*F24C 3/12* (2006.01)
*F23N 5/18* (2006.01)

(52) U.S. Cl.
CPC .... *F23N 2005/185* (2013.01); *F23N 2223/38* (2020.01); *F23N 2225/04* (2020.01); *F23N 2241/08* (2020.01)

(58) Field of Classification Search
USPC ..... 431/78, 45, 24, 22, 18, 15
See application file for complete search history.

(56) References Cited

U.S. PATENT DOCUMENTS

| | | | | |
|---|---|---|---|---|
| 9,228,746 | B2 * | 1/2016 | Hughes | F23N 5/102 |
| 9,557,059 | B2 * | 1/2017 | Kucera | F16K 37/0041 |
| 2007/0068511 | A1 * | 3/2007 | Bachinsky | F24B 1/1808 126/503 |
| 2008/0092826 | A1 * | 4/2008 | Kishimoto | F23N 5/242 122/14.2 |
| 2009/0240445 | A1 * | 9/2009 | Umekage | G01F 1/66 702/45 |
| 2010/0330515 | A1 * | 12/2010 | Ueki | F23N 5/242 340/632 |
| 2012/0293335 | A1 * | 11/2012 | Struyk | F23D 14/72 73/861 |
| 2013/0260320 | A1 * | 10/2013 | Townsend | F24C 7/08 431/14 |
| 2016/0247376 | A1 * | 8/2016 | Zhang | G08B 29/188 |
| 2017/0031337 | A1 * | 2/2017 | Jablokov | G05D 7/0635 |
| 2017/0115002 | A1 | 4/2017 | Kucera et al. | |
| 2018/0253953 | A1 * | 9/2018 | Bucsa | F24C 15/2021 |

* cited by examiner

METHOD FOR DETECTING ANOMALIES ASSOCIATED WITH A GAS APPLIANCE

Generally, the present invention relates to the field of gas appliances. More specifically, the present invention relates to a method for anomaly detection of gas appliances, specifically of household gas appliances.

BACKGROUND OF THE INVENTION

Gas appliances, specifically domestic cooking appliances using gas as energy source are tested regarding gas leakage after appliance assembly.

After installing the gas appliance, a technician repeats gas leakage test in order to check the leakage-free connection between domestic gas pipe and gas appliance.

Disadvantageously, during the life time of the gas appliance, no further gas leakage test is performed. Therefore, small leakages in the gas appliance (in the following referred to as gas flow anomalies) are often not detected for a long period of time. In addition, known gas appliances are not configured to detect operational anomalies, for example, an ignited gas burner which is powered for a long period of time.

SUMMARY OF THE INVENTION

It is an objective of the embodiments of the present invention to provide a method for detecting anomalies associated with gas appliances. If not explicitly indicated otherwise, embodiments of this invention and single features of said embodiments can be freely combined with each other.

According to an aspect, the invention relates to a method for detecting anomalies associated with a gas appliance. The gas appliance comprise at least a gas inlet, at least one gas burner and gas distribution means coupling the gas inlet with said at least one gas burner. The method comprises the following steps:

In a first step, information regarding the gas flow or the operational state is gathered based on first and/or second detection means. Said information may refer to the ignition state of one or more gas burners, to the provision of gas to the gas burner or other information which are indicative for an operational feature or state parameter of the gas appliance.

In the following, said gathered information is evaluated in order to detect gas flow anomalies or operational anomalies, thereby obtaining evaluation information. For example, measurement values of one or more operational parameters may be provided to a control entity of the gas appliance in order to evaluate said measurement values and derive said evaluation information.

Alert information is transmitted from a communication interface of the gas appliance to a user device depending on said evaluation information. Specifically, alert information may be transmitted if said evaluation information is indicative for a gas flow anomaly or operational anomaly and the user has to be informed via the user device regarding said anomaly.

Said method is advantageous because gas leakage or other operational anomalies (e.g. forgotten ignited gas burner) are detected by the gas appliance itself and the user is informed at a user device regarding said detected anomaly. Thereby the operational safety is significantly enhanced.

According to embodiments, said detection means for gathering information regarding the operational state comprise a thermocouple associated with a gas burner, a flow meter, a pressure detector and/or an electronic gas valve. Based on the thermocouple it is possible to determine if the gas burner is ignited or not. Also other sensor means for detecting ignition state of the gas burner may be possible, for example, an ionization sensor. Based on sensor means like flow meter, pressure detector and/or electronic gas valve it is possible to monitor the operational state of the gas appliance and therefore derive information if an abnormal operational state occurred.

According to embodiments, the operational state of said detection means is monitored based on electric feedback information provided by said detection means. For example, a thermocouple may provide a voltage value indicative for the ignition state of the gas burner associated with said thermocouple. Similarly, a flow meter may provide an electric measurement value indicative for the gas volume flowing through said flow meter, a pressure detector may provide an electric measurement value indicative for the gas pressure present at said pressure detector and/or an electronic gas valve may provide operational state information regarding the valve state (position feedback open/closed). Thereby, the operational state of the gas appliance can be monitored.

According to embodiments, said detection means provide information regarding the operational state of one or more gas burners based on a voltage value or based on the electric power absorbed by said detection means. For example, the voltage value provided by a thermocouple may be indicative for the ignition state of the gas burner, a voltage value provided by an electronic gas valve may be indicative for the position of the value (i.e. open/closed) and the absorbed electric power of an electronic gas valve may also be indicative for the operational state, respectively, position of the value.

According to embodiments, information provided by two or more detection means, specifically information of a flowmeter included in said gas appliance and a thermocouple associated with a gas burner are evaluated in order to detect gas flow anomalies or operational anomalies. Said flow meter may provide information indicative for a gas flow provided through the gas appliance and the thermocouple (or another kind of flame detecting sensor) may be indicative for the ignition state of the gas burner.

According to embodiments, a gas flow anomaly is detected if said flowmeter information indicates gas flow through the gas appliance and said information provided by the thermocouple indicates that the gas burner is switched off. Such set of information may provide a hint to a gas leakage within the gas burner. In addition, an operational anomaly may be detected if said flowmeter information indicates gas flow through the gas appliance, said information provided by the thermocouple indicates that the gas burner is switched on and the period of time during which said information is present exceeds a certain time threshold. Such set of information may be indicative that the gas burner has been forgotten to be switched off.

According to embodiments, said detection means detect the pressure or flow rate of gas in or through said gas distribution means. The pressure may be detected based on a pressure detector and the flow rate of gas may be detected based on a flow meter included in a gas rail (centrally installed flow meter) or one or more flow meter included in gas pipes coupling the gas rail with the respective gas burner.

According to embodiments, said detection means comprise an electronic gas valve, said electronic gas valve being adapted to provide feedback information regarding the operational state of the electronic gas valve. Said electronic gas valve may couple a gas burner with said gas rail in order to control the gas flow to said gas burner. Said feedback information may be provided to a control entity in order to derive said evaluation information based on said feedback information.

According to embodiments, said detection means are included in the respective gas pipe providing gas to the respective gas burner or are included in a gas rail for centrally monitoring the gas flow provided through the gas appliance.

According to embodiments, said communication interface is coupled with a router on a wired or wireless basis, said router providing the connection to said user device. Said router may be, for example, a WIFI-router. Alternatively, said communication interface may be adapted to directly communicate with the user device (for example, via Bluetooth or other short-link telecommunication technologies).

According to embodiments, said communication interface receives operational information from said user device, said operational information initiating an operational task at the gas appliance or at a gas supply entity (comprising, for example, a central shut-off valve) coupled with said gas appliance. Thereby, a user is able to remotely control the gas appliance, respectively, a gas supply entity providing gas to said gas supply entity.

According to embodiments, said operational task includes closing a gas valve included in the gas appliance and/or closing a shut-off valve included in a gas supply entity coupled with said gas appliance. Thereby, a user is able to switch off the gas appliance if a gas leakage or other operational anomalies are detected.

According to embodiments, said operational task includes actively reducing the voltage provided by the thermocouple to a gas valve (or gas tap) included in the gas appliance in order to close said gas valve. By manipulating the voltage level provided by the thermocouple, the gas valve coupled with the thermocouple can be influenced, specifically, the gas valve can be closed by said voltage level manipulation.

According to a further aspect, a gas appliance, specifically, a domestic gas appliance is disclosed. The gas appliance comprises at least a gas inlet, at least one gas burner and gas distribution means coupling the gas inlet with said at least one gas burner. The gas appliance further comprises:

- detection means for gathering information regarding the gas flow or the operational state of the gas appliance;
- evaluation means coupled with said detection means, said evaluation means being adapted to gather information in order to detect gas flow anomalies or operational anomalies and adapted to provide evaluation information;
- a communication interface adapted to provide alert information to a user device based on said evaluation information.

"Gas appliance" according to the present invention may refer to any appliance which is powered, respectively, heated by gas, specifically domestic gas appliances like gas hobs, gas ovens etc.

"User device" according to the present invention may refer to any device which is adapted to provide information to a user.

More specifically, "user device" may be, for example, a handheld telecommunication user device like handy, smartphone, tablet-PC etc. which can be inform a user remotely.

The terms "essentially", "substantially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
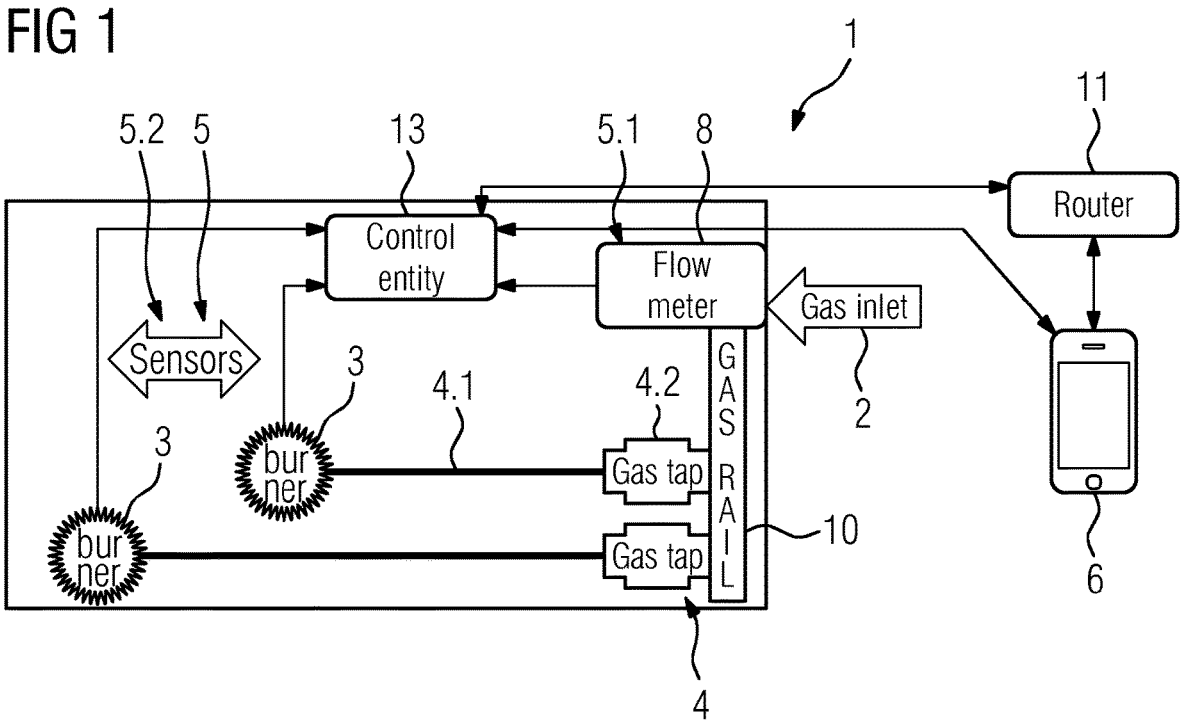
FIG. 1 shows a schematic diagram of a first embodiment of a gas appliance communicating with a user device.

The present invention will now be described more fully with reference to the accompanying drawings, in which example embodiments are shown. However, this invention should not be construed as limited to the embodiments set forth herein. Throughout the following description, similar reference numerals have been used to denote similar elements, parts, items or features, when applicable.

Figure 2:
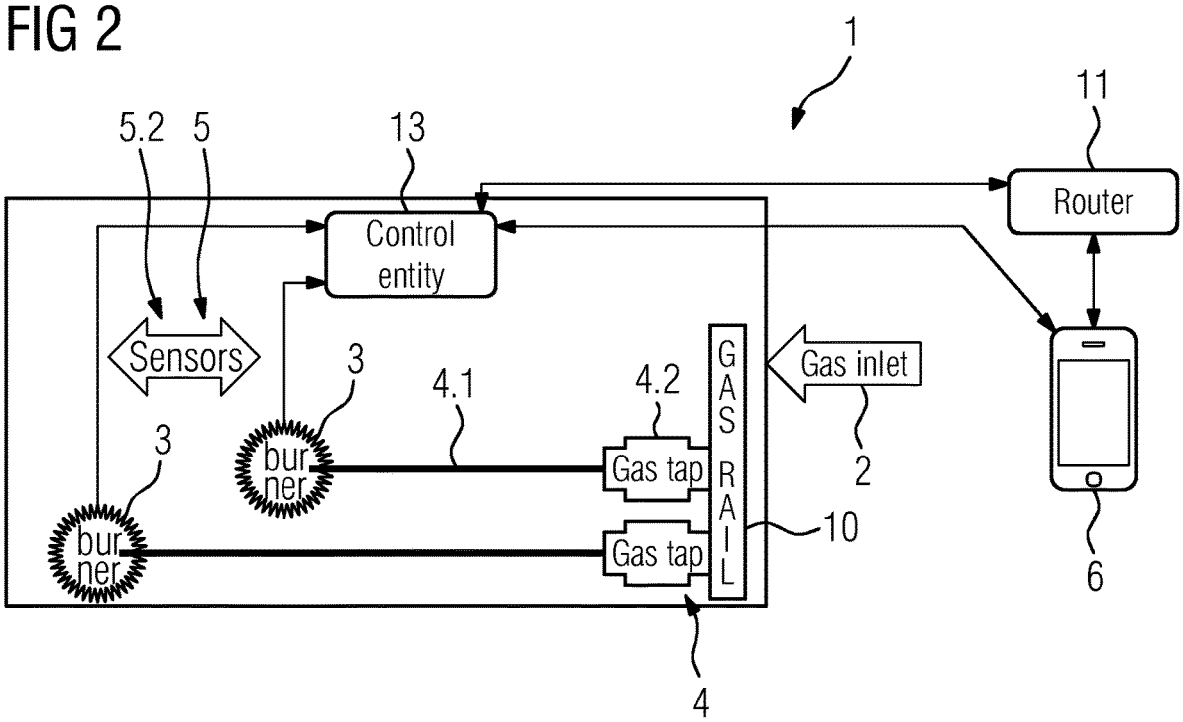
FIG. 2 shows a schematic diagram of a second embodiment of a gas appliance communicating with a user device.

FIG. 1 illustrates a first embodiment of a gas appliance 1 coupled with a user device 6 for informing a user in case of detected anomalies and FIG. 2 illustrates a simplified version of the embodiment in FIG. 1 without a flowmeter.

The gas appliance 1 comprises a gas inlet 2 based on which said gas appliance 1 is coupled with a gas pipe providing gas to the appliance. Furthermore, the gas appliance 1 comprises gas distribution means 4. Said gas distribution means 4 are adapted to distribute gas within the gas appliance 1 towards one or more gas burners 3. Said gas distribution means 4 may comprise a gas rail 10 which receives gas from the gas inlet 2 and which provides said gas via gas pipes 4.1 included in the gas appliance 1 to said one or more gas burners 3.

Each gas burner 3 may be coupled with said gas rail 10 via a gas tap 4.2. Said gas tap 4.2 may be adapted to open or close the gas pipe 4.1 in order to enable or disable the provision of gas to the gas burner 3.

In order to monitor the gas flow through the gas appliance 1, the gas appliance 1 comprises detection means 5, specifically, first detection means 5.1. In the present embodiment, said first detection means 5.1 comprise a flow meter 8. Said flow meter 8 may be adapted to detect if gas is flowing through the gas appliance 1, specifically, if gas is flowing through the gas rail 10 of the gas appliance 1. According to other embodiments, a flow meter 8 may be included in the gas pipe 4.1 coupling the gas burner 3 with the gas rail 10. So, in other words, the flow meter 8 may be a centrally installed flow meter which monitors the gas flow to all gas burners 3 or the flow meter 8 may be associated with a certain gas burner 3 in order to monitor the gas flow solely through said single gas burner 3. According to a further embodiment, a subgroup of gas burners 3 may be monitored by a flow meter 8 associated with said gas burner subgroup.

Furthermore, one or more second detection means 5.2 may be associated with each gas burner 3 based on which the operational state of the gas burner 3 can be detected. Said second detection means 5.2 may comprise a sensor (e.g. a flame detector), said sensor being adapted to provide information whether flames are provided at the gas burner 1 or not.

According to preferred embodiments, said second detection means 5.2 may be built by a thermocouple which is associated with the gas burner 3. The output, specifically, the electrical output of the thermocouple can be used for detecting whether the gas burner 3 is active or not. For example, the control entity 13 may be adapted to measure the electrical output of the thermocouple and may be adapted to compare said output with a threshold value in order to determine whether the gas burner 3 is ignited or not. For example, the electrical output of the thermocouple may provide a hint that the gas burner 3 is ignited if the electrical output is above the threshold value (e.g. output voltage >2 mV), respectively, that the gas burner 3 is not ignited if the electrical output is equal or below the threshold value (e.g. output voltage ≤2 mV). According to other embodiments, said second detection means 5.2 may comprise a flame detector including an ionization sensor.

Based on said first and second detection means 5.1, 5.2 it is possible to detect a gas leakage within the gas appliance 1. Said detection capabilities may be provided by said control entity 13. Said control entity 13 may be coupled with said first and second detection means 5.1, 5.2 in order to receive electrical information from said detection means 5.1, 5.2. Based on said received information, the control entity 13 is able to determine whether there is a gas flow through the gas appliance 1 and whether one or more gas burners 3 are ignited. So, in other words, the control entity 13 is adapted to evaluate information gathered from said detection means 5.1, 5.2 and obtain evaluation information, said evaluation information being indicative for an operational abnormality or gas flow abnormality.

The control entity 13 may be adapted to detect a gas flow abnormality if first detection means 5.1 indicate a gas flow through the gas appliance 1 and second detection means 5.2 indicate that no gas burner 3 is ignited. Such situation may be indicative for a gas leakage within the gas distribution means 4. Furthermore, the control entity 13 may indicate an operational abnormality if first and second detection means 5.1, 5.2 indicate a gas flow, respectively, ignited gas burners 3 for a long period of time, specifically, longer than a certain upper time limit (e.g. four hours or more) which may be an indicator that the user of the gas appliance 1 has forgotten to switch of the gas appliance 1.

In case of detecting an operational abnormality or gas flow abnormality, the gas appliance 1 may provide alert information to a user associated with the gas appliance 1.

More in detail, the gas appliance 1 may comprise a communication interface which is adapted to provide information to a user device 6 of a user. The user device 6 may be coupled with the gas appliance 1 on a wired or wireless base, for example using wireless communication protocols like Bluetooth, WLAN, ZigBee, NFC, Wibree or WiMAX.

The gas appliance 1 may be directly coupled with the user device 6 or a router 11 may be used which enables a communication between the gas appliance 1 and the user device 6 in case that no short-link communication (e.g. Bluetooth) is possible. Specifically, the router 11 may provide a link to the internet and enables transmission of information between the gas appliance 1 and the user device 6 via internet. The communication link between the gas appliance 1 and the user device 6 may be unidirectional (from the gas appliance 1 to the user device 6) or bidirectional (from the gas appliance 1 to the user device 6 and vice versa).

In case of detecting an operational abnormality or gas flow abnormality, the gas appliance 1 may send alert information via the communication interface to the user device 6 in order to inform the user regarding said operational abnormality or gas flow abnormality. For example, said alert information may indicate that gas is flowing through the gas appliance 1 although no gas burner 3 is ignited or that one or more gas burners 3 are active for a long time, i.e. switch off of the gas burner 3 has been forgotten.

In addition, it may be possible to monitor the operational state of the gas appliance 1 based on the user device 6, for example, which gas burner 3 is ignited, which heating power is provided at the respective gas burner 3 etc. (cf. FIG. 2).

In case of a bidirectional communication link between the gas appliance 1 and the user device 6, the user may be able to interact remotely with the gas appliance 1 by means of the user device 6. More in detail, the user may be able to initiate a command at the user device 6, based on which a certain action is performed at the gas appliance 1 or an entity coupled with the gas appliance 1.

For example, in case of an operational abnormality (gas burner 3 runs longer than a certain threshold value), the user may be able to remotely switch off one or more gas burners 3 by performing a user interaction at the user device 6.

For example, the control entity 13 of the gas appliance 1 may receive information from the user device 6 via said communication link and may initiate a closing action of a gas tap 4.2 which is associated with the ignited gas burner 3.

Said closing of the gas tap 4.2 may be performed in different ways. For example, the gas tap 4.2 may be coupled with a thermocouple in order to close the gas tap 4.2 depending on the output of the thermocouple. According to embodiments, the thermocouple may provide an electric voltage based on which the gas tap 4.2 is opened or closed. The control entity 13 may be adapted to manipulate, specifically reduce said voltage in order to close the gas tap 4.2 associated with the ignited gas burner 3. Thereby, a remote switch-off of an ignited gas burner 3 can be obtained by the user device 6.

Figure 3:
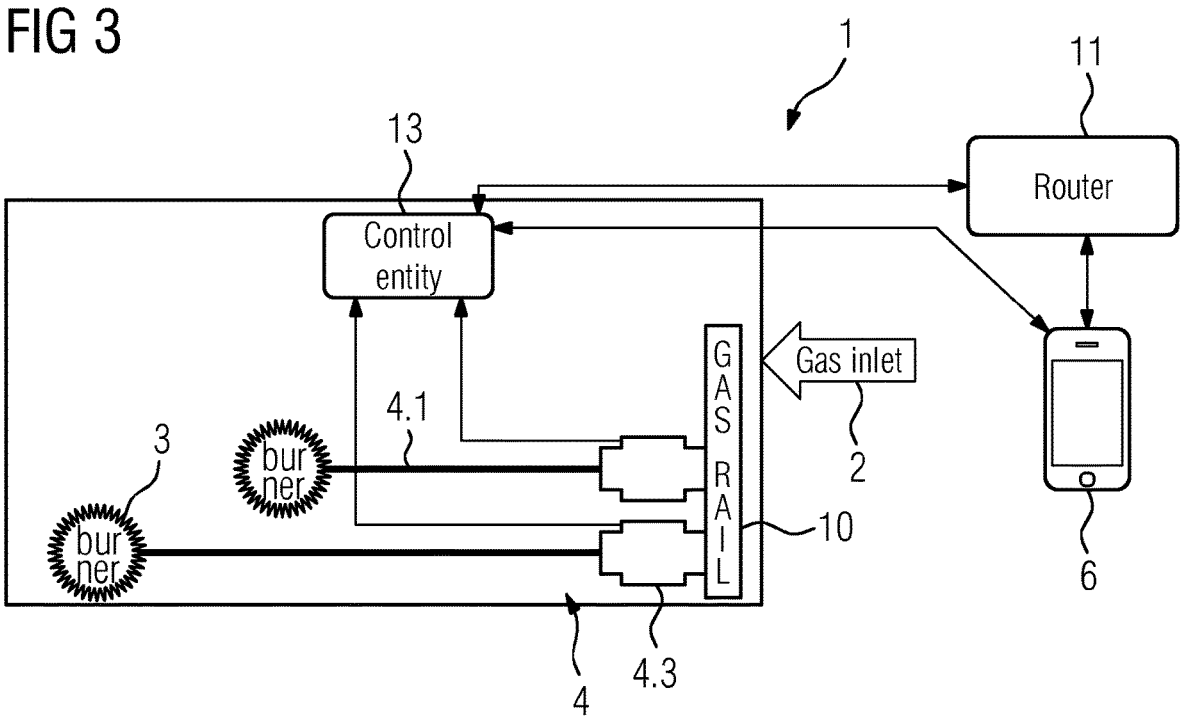
FIG. 3 shows a schematic diagram of a third embodiment of a gas appliance communicating with a user device.

FIG. 3 shows a further embodiment of a gas appliance 1 being adapted to be remotely monitored regarding anomalies. In the following, only differences compared to the embodiments described before are explained. In all other respects, the features described before can also be applied in the embodiment according to FIG. 3, also, if not explicitly shown in FIG. 3.

The main difference of the embodiment according to FIG. 3 compared to the embodiments of FIGS. 1 and 2 is that electronic gas valves 4.3 are used instead of gas taps 4.2. Each electronic gas valve 4.3 may be associated with a certain gas burner 3 in order to activate/deactivate the provision of gas to the respective gas burner 3. For example, said electronic gas valves 4.3 may be directly attached to the gas rail 10 which distributes gas received from the gas inlet 2 to the respective gas burner 3.

Based on the electronic gas valve 4.3 it is possible to monitor the valve-position (opened/closed position) in case that the electronic gas valve 4.3 provides electric position feedback information. In addition, it is possible to monitor the electric power consumed by the electronic gas valve 4.3 in order to determine if the electronic valve 4.3 is open or closed. For example, the power consumption of the electronic gas valve 4.3 is higher in open state because the valve may be of self-closing type.

By monitoring the electric properties (position feedback information or consumed electric power) of the electronic gas valves 4.3 it is possible to determine whether the respective electronic gas valve 4.3 is open or closed. Said open/closed state may be indicative if the gas burner 3 coupled with the respective electronic gas valve 4.3 is ignited or not.

The electronic gas valve 4.3 can also be used to close the gas supply of a gas burner 3 in case of a detected operational abnormality (i.e. gas burner 3 runs longer than a certain threshold value) or gas flow abnormality. For example, the electronic gas valve 4.3 may be coupled with the control entity 13. The user may be able to remotely control the electronic gas valve 4.3 via the user device 6, for example, after receiving alert information.

The electronic gas valve 4.3 may further be adapted to comprise the functionality of detection means, i.e. may be adapted to monitor the gas flow through the electronic gas valve 4.3 and thereby detect gas flow anomalies.

Figure 4:
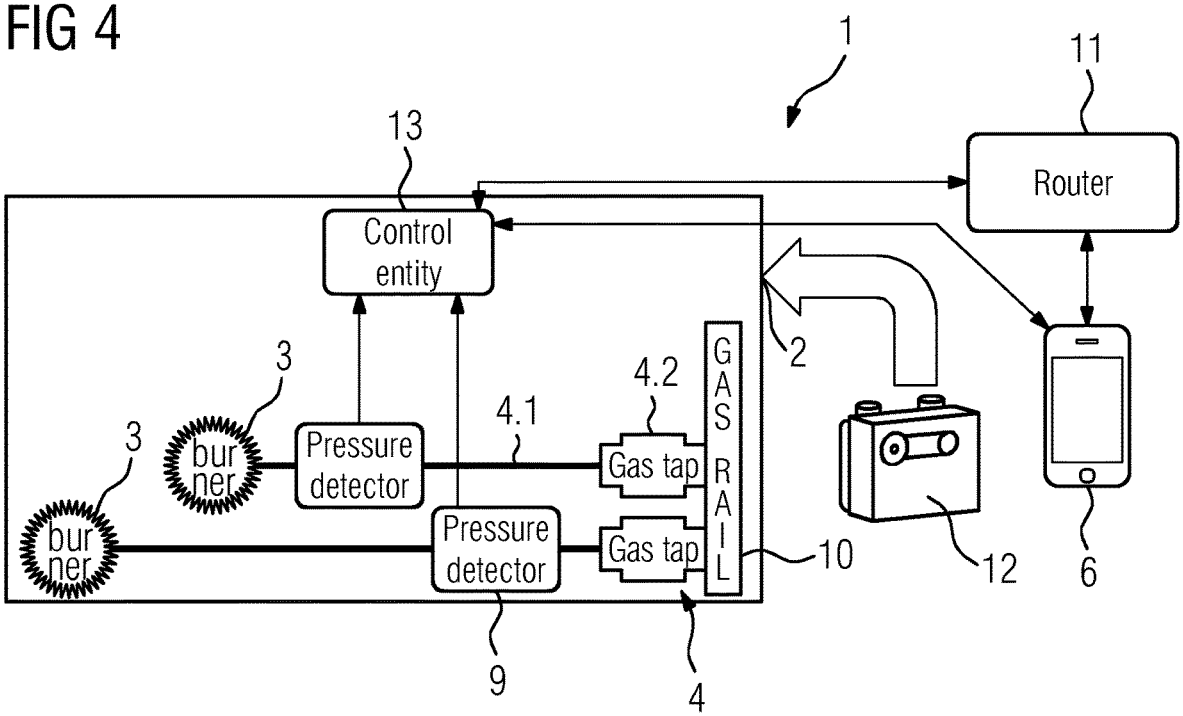
FIG. 4 shows a schematic diagram of a fourth embodiment of a gas appliance communicating with a user device.

FIG. 4 shows yet a further example embodiment of a gas appliance 1 being adapted to be remotely monitored regarding anomalies. In the following, only differences compared to the embodiments described before are explained. In all other respects, the features described before can also be applied in the embodiment according to FIG. 4, also, if not explicitly shown in FIG. 4.

The first main difference is that—instead of a flow meter 8—a pressure detector 9 is included in the gas appliance 1. More in detail, each gas pipe 4.1 coupling the gas burner 3 with a gas rail 10 may comprise a pressure detector 9 in order to detect the pressure of gas included in the gas pipe 4.1. Said pressure detector 9 may be coupled with the control entity 13. Based on the pressure value provided by the pressure detector 9, the control entity 13 is able to determine if gas is flowing through the gas pipe 4.1 or not. For example, a high pressure value (lower than a threshold value, specifically >0 mbar) may indicate an ignited gas burner 3 whereas a low pressure value (e.g. higher than a threshold value, specifically 0 mbar) is indicative for a non-ignited gas burner 3. However, said gas flow may also be caused by a gas leakage in the gas pipe 4.1.

Similar to the embodiments of FIGS. 1 and 2, the gas appliance 1 may comprise second detection means 5.2 (flame detector, thermocouple etc.) which are associated with each gas burner 3. Based on said second detection means 5.2, the operational state of the respective gas burner 3 can be detected. Specifically, said second detection means 5.2 may comprise a sensor adapted to provide information whether flames are provided at the gas burner 1 or not. Said second detection means 5.2 may also be coupled with the control entity 13 in order to provide information to the control entity 13 which gas burner 3 is ignited.

As described before, based on said information of the second detection means 5.2 and the pressure detector(s) 9, the control entity 13 is able to determine whether a gas flow anomaly or an operational anomaly exists.

The second main difference of the embodiment of FIG. 4 compared to the embodiments described before is that the gas appliance 1 is coupled at its gas inlet 2 with a gas supply entity 12. Said gas supply entity 12 may be a central flow meter, for example, centrally installed in the house or building in which the gas appliance 1 is installed. Said gas supply entity 12 may comprise a shut-off valve which can be controlled remotely. Said gas supply entity 12 is operationally coupled with the gas appliance, specifically with the control entity 13 of the gas appliance 1 in order to close said shut-off valve based on user input provided to the user device 6. Thereby the provision of gas to the gas appliance 1 can be centrally stopped in case of detected gas flow or operational anomalies. It is worth mentioning, that uppermentioned gas supply entity 12 including a shut-of valve can also be used in embodiments according to FIGS. 1 to 3.

Figure 5:
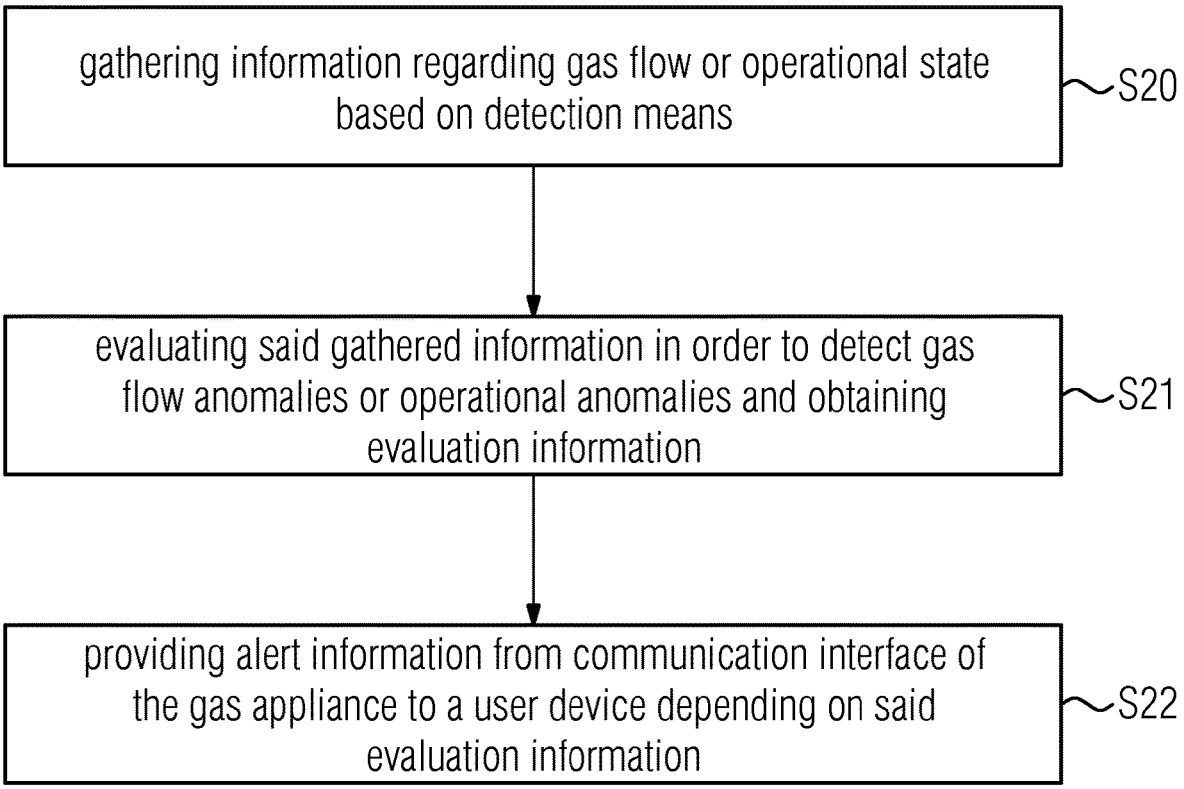
FIG. 5 shows a schematic diagram illustrating method steps of a method for detecting anomalies associated with a gas appliance.

FIG. 5 illustrates method steps of a method for detecting anomalies in a gas appliance 1 based on a schematic block diagram.

In a first step, information regarding the gas flow or the operational state based on detection means (5.1, 5.2) are gathered (S20).

Said gathered information are evaluated in order to detect gas flow anomalies or operational anomalies, thereby obtaining evaluation information (S21).

Finally, alert information is provided from a communication interface of the gas appliance to a user device depending on said evaluation information (S22). Thereby, the user is informed regarding an anomaly detected by the gas appliance 1.

The method may further comprise a further step of deactivating the gas appliance or gas burner based on a user input at the user device. After receiving the alert information, the user can decide to remotely deactivate the appliance or gas burner by a remote operation at the user device.

It should be noted that the description and drawings merely illustrate the principles of the proposed invention. Those skilled in the art will be able to implement various arrangements that, although not explicitly described or shown herein, embody the principles of the invention.

LIST OF REFERENCE NUMERALS

1 gas appliance
2 gas inlet
3 gas burner
4 gas distribution means
4.1 gas pipe
4.2 gas tap
4.3 electronic gas valve
5 detection means
5.1 first detection means
5.2 second detection means
6 user device
8 flow meter
9 pressure detector
10 gas rail
11 router
12 gas supply entity
13 control entity

The invention claimed is:

1. A method for detecting anomalies associated with a gas appliance, the gas appliance comprising at least a gas inlet, at least one gas burner and gas distribution means coupling the gas inlet with said at least one gas burner, the method comprising the steps of:

gathering information regarding gas flow or an operational state based on detection means said detection means comprising a flowmeter included in said gas appliance and a thermocouple associated with the at least one gas burner;

evaluating said gathered information in order to detect gas flow anomalies or operational anomalies, thereby obtaining evaluation information;

providing alert information from a communication interface of the gas appliance to a user device depending on said evaluation information, wherein information provided by said flowmeter and by said thermocouple is evaluated in order to detect gas flow anomalies or operational anomalies and wherein a gas flow anomaly is detected when said flowmeter information indicates gas flow through the gas appliance and said information provided by the thermocouple indicates that the gas burner is switched off, and/or an operational anomaly is detected when said flowmeter information indicates gas flow through the gas appliance, said information provided by the thermocouple indicates that the gas burner is switched on and the period of time during which said information is present exceeds a certain time threshold.

2. The method according to claim 1, wherein said detection means for gathering information regarding the operational state comprise a thermocouple associated with said at least one gas burner, and/or a flow meter and/or a pressure detector and/or an electronic gas valve.

3. The method according to claim 1, wherein the operational state is monitored based on electric feedback information provided by said detection means.

4. The method according to claim 1, wherein said detection means provide information regarding the operational state of one or more gas burners based on a voltage value or based on electric power absorbed by said detection means.

5. The method according to claim 1, wherein said detection means detect a pressure or flow rate of gas in or through said gas distribution means.

6. The method according to claim 5, wherein said detection means comprise a pressure detector or a flowmeter.

7. The method according to claim 1, wherein said detection means comprise an electronic gas valve, said electronic gas valve being adapted to provide feedback information regarding the operational state of the electronic gas valve.

8. The method according to claim 5, wherein said detection means are included in a respective gas pipe of said distribution means providing gas to a respective gas burner or are included in a gas rail of said gas distribution means for centrally monitoring the gas flow provided through the gas appliance.

9. The method according to claim 1, wherein said communication interface is coupled with a router on a wired or wireless basis, said router providing a connection to said user device and/or said communication interface is adapted to directly communicate with the user device.

10. The method according to claim 1, wherein said communication interface receives operational information from said user device, said operational information initiating an operational task at the gas appliance or at a gas supply entity coupled with said gas appliance.

11. The method according to claim 10, wherein said operational task includes closing a gas valve included in the gas appliance and/or closing a shut-off valve included in the gas supply entity coupled with said gas appliance.

12. The method according to claim 10, wherein said operational task includes actively reducing a voltage provided by a thermocouple associated with said at least one gas burner to a gas tap included in the gas appliance in order to close a gas valve.

13. A domestic gas appliance, the gas appliance comprising at least a gas inlet, at least one gas burner and gas distribution means coupling the gas inlet with said at least one gas burner, the gas appliance further comprising:

detection means for gathering information regarding a gas flow or an operational state of the gas appliance, said detection means comprising a flowmeter and a thermocouple associated with said at least one gas burner;

a controller coupled with said detection means, said controller being adapted to gather information in order to detect gas flow anomalies or operational anomalies and adapted to provide evaluation information;

a communication interface adapted to provide alert information to a user device based on said evaluation information, wherein the controller is configured to evaluate information provided by said flowmeter and said thermocouple in order to detect gas flow anomalies or operational anomalies and wherein the controller is configured to detect a gas flow anomaly when said flowmeter information indicates gas flow through the gas appliance and said information provided by the thermocouple indicates that the gas burner is switched off, and/or the controller is configured to detect an operation anomaly when said flowmeter information indicates gas flow through the gas appliance, said information provided by the thermocouple indicates that the gas burner is switched on and the period of time during which said information is present exceeds a certain time threshold.

14. The gas appliance according to claim 13 wherein a user, through the user device can start an operational task which includes closing a gas valve included in the gas appliance and/or closing a shut-off valve included in a gas supply entity coupled with said gas appliance.

15. A method for detecting anomalies in a gas appliance, comprising:

a) a first sensor of the appliance communicating to a controller of the appliance a first sensor signal indicative of a gas flow rate through the appliance, said first sensor comprising a flowmeter;

b) a second sensor of the appliance communicating to said controller a second sensor signal indicative of an ignition state of a gas burner of the appliance, said second sensor comprising a thermocouple or a flame ionization sensor associated with said burner;

c) said controller evaluating said first and second sensor signals and thereby determining there to be present:

a. a gas leak, when both the first sensor signal indicates positive gas flow through said appliance and the second sensor signal indicates said burner is not ignited; and b. extended operation of the gas burner, when for a predetermined period of time both the first sensor signal indicates positive gas flow through said appliance and the second sensor signal indicates said burner is ignited; and d) said appliance communicating alert information via a communication interface to a user device to indicate that a gas leak is present in the appliance and/or that said burner has been operating for an extended period of time as determined by said controller based on evaluating said first and second sensor signals.

16. The method according to claim 15, further comprising the appliance receiving an operational command signal via said communication interface from said user device, said controller executing a function to shut off gas flow to said burner and/or to said appliance based on said operational command signal.

17. The method according to claim 15, said flowmeter associated with a gas rail of said appliance connected in fluid communication with a gas supply and adapted to distribute gas to said burner via a gas-supply line therebetween, a gas valve installed inline with said gas-supply line and being adapted to regulate flow of gas therethrough from said gas rail to said burner, said controller being operatively coupled to said flow meter, to said thermocouple or flame ionization sensor, and to said gas valve, said controller further operating said gas valve to shut off said valve in response to: a) detecting either a gas leak or extended operation of the burner based on evaluating said first and second sensor signals, orb) an operational command signal received by said appliance via said communication interface from said user device.

18. The method according to claim 15, said first and second sensors being adapted to provide feedback information concerning an operational state of said gas appliance to said controller, said appliance communicating said feedback information indicative of said operational state to said user device via said communication interface.

* * * * *